US010941746B2

(12) United States Patent
Black

(10) Patent No.: US 10,941,746 B2
(45) Date of Patent: Mar. 9, 2021

(54) I.C.E., IGNITER ADAPTED FOR OPTIONAL PLACEMENT OF AN INTEGRAL FUEL INJECTOR IN DIRECT FUEL INJECTION MODE

(71) Applicant: Alfred Anthony Black, Avon Park, FL (US)

(72) Inventor: Alfred Anthony Black, Avon Park, FL (US)

( * ) Notice: Subject to any disclaimer, the term of this patent is extended or adjusted under 35 U.S.C. 154(b) by 72 days.

(21) Appl. No.: 13/833,276

(22) Filed: Mar. 15, 2013

(65) Prior Publication Data

US 2014/0261272 A1 Sep. 18, 2014

(51) Int. Cl.

| | |
|---|---|
| ***F02P 19/02*** | (2006.01) |
| ***F02M 57/06*** | (2006.01) |
| ***F02P 13/00*** | (2006.01) |
| ***H01T 13/22*** | (2006.01) |
| *H01T 13/46* | (2006.01) |
| *H01T 13/40* | (2006.01) |

(52) U.S. Cl.

CPC ..... *F02P 19/02* (2013.01); *F02M 57/06* (2013.01); *F02P 13/00* (2013.01); *H01T 13/22* (2013.01); *H01T 13/40* (2013.01); *H01T 13/46* (2013.01)

(58) Field of Classification Search

CPC ..... F02P 19/028; F02P 5/045; F02P 19/025; F02P 2017/125; F02P 19/02; F02P 13/00; H01T 13/22; H01T 13/46; H01T 13/40; F02M 57/06

USPC ..... 123/297, 151, 152, 169 V

See application file for complete search history.

(56) References Cited

U.S. PATENT DOCUMENTS 3,926,169 A * 12/1975 Leshner et al. ..... 123/297
4,006,725 A * 2/1977 Baczek ..... F02M 57/06 123/267
4,095,580 A * 6/1978 Murray ..... F02M 57/06 123/297
4,407,252 A * 10/1983 Dilliner ..... F02M 57/00 123/504
4,448,160 A * 5/1984 Vosper ..... F02P 13/00 129/169 PA (Continued)

FOREIGN PATENT DOCUMENTS

GB 2311327 A * 9/1997 ..... F02B 17/005

*Primary Examiner* — David Hamaoui
(74) *Attorney, Agent, or Firm* — Nelson Patent Law

(57) ABSTRACT

An igniter (09) includes an elongated tubular housing (10) with a polygonal top (14) having a central aperture (16) defined therein, communicating into a central chamber (20) along a longitudinal axis to an end at a base (18). A terminal (13*a*) projects from the polygonal top (14). A channel (11*a*) along a longitudinal axis is formed within the housing (10) in which is mounted an insulator (15). At least a portion of the insulator (15) may extend from the base (18). An electrode (13) connected to the terminal (13*a*) or (13*b*) is embedded within the insulator (15), to an end in the base (18). Prongs (19) extend from the electrode (13) towards the outer periphery of the housing (10) or towards the central chamber (20). The prongs (19) end in proximity to the outer housing wall (11), or the inner housing wall (12). The prongs (19) may be one or more projections and have sharp edges for multiple and increased spark presentations. A ring (30) may be connected to the electrode (13), defining a heating element in the base (18). Electrical resistance of the igniter (09) is selected.

6 Claims, 4 Drawing Sheets

(56) References Cited

U.S. PATENT DOCUMENTS

| | | | | | |
|---|---|---|---|---|---|
| 5,063,898 | A * | 11/1991 | Elliott | F02M 49/02 | 123/297 |
| 5,497,744 | A * | 3/1996 | Nagaosa | F02M 51/005 | 123/297 |
| 5,715,788 | A * | 2/1998 | Tarr et al. | 123/297 | |
| 6,062,185 | A * | 5/2000 | Chiu | F23Q 7/001 | 123/145 A |
| 6,144,015 | A * | 11/2000 | Chiu | F23Q 7/001 | 123/145 A |
| 6,340,015 | B1 * | 1/2002 | Benedikt et al. | 123/297 | |
| 6,536,405 | B1 * | 3/2003 | Rieger | F02M 51/0671 | 123/297 |
| 6,955,154 | B1 * | 10/2005 | Douglas | 123/297 | |
| 7,849,682 | B2 * | 12/2010 | Miller et al. | 60/303 | |
| 8,069,836 | B2 * | 12/2011 | Ehresman | 123/297 | |
| 8,091,528 | B2 * | 1/2012 | McAlister | 123/297 | |
| 2002/0033156 | A1 * | 3/2002 | Jayne | 123/169 EL | |
| 2002/0134347 | A1 * | 9/2002 | Artioli | F02M 57/06 | 123/297 |
| 2003/0168038 | A1 * | 9/2003 | Leonard McKay | F02M 51/0671 | 123/297 |
| 2005/0211214 | A1 * | 9/2005 | Tomita | F23Q 7/001 | 123/145 A |
| 2005/0224043 | A1 * | 10/2005 | Vogel | H01T 13/22 | 123/297 |
| 2006/0102140 | A1 * | 5/2006 | Sukegawa | F02B 23/101 | 123/297 |
| 2006/0169244 | A1 * | 8/2006 | Allen | F02D 35/021 | 123/297 |
| 2008/0072871 | A1 * | 3/2008 | Vogel | F02M 57/06 | 123/297 |

* cited by examiner

I.C.E., IGNITER ADAPTED FOR OPTIONAL PLACEMENT OF AN INTEGRAL FUEL INJECTOR IN DIRECT FUEL INJECTION MODE

PURPOSE OF THE INVENTION

The purpose of this invention is to produce a fuel igniter adapted as a spark plug and a glow plug in common usage terms, that is configured to be the receptacle of the fuel injector. It makes direct fuel injection more feasible for all internal combustion engines, past, present, and future; and more cost effective. It also enables both igniter and fuel injector to be sited in the center of the combustion chamber, to provide the most complete fuel burn. Additionally, it makes possible the siting of two or three necessary devices of the ignition process, to one location.

BACKGROUND OF THE INVENTION

1. Field of the Invention

The field of this invention resides in the category of delivery of an igniter element, into the combustion chamber of an internal combustion engine. The igniter element may be a spark produced by a spark plug in gasoline engines, or heat produced by a glow plug in diesel, engines. A device is inserted into the combustion chamber, to initiate the burning sequence of the surrounding air and fuel mixture.

2. History of the Prior Art.

There have been many designs of spark plugs over the years. One that relates to this device is a U.S. publication #2005/0040749A1, of an invention by Maurice E. Lindsay of El Segundo, Calif., U.S.A. Of necessity, an aperture must be made into the walls of the combustion chamber to allow this igniter to have access to the air and fuel mixture. Early in the prior art, carburetors were used to accomplish the air and fuel mixing according to a stoichometric ratio of 15:1 air and fuel. Carburetors were positioned at a distance from the combustion chamber. Later, fuel injectors replaced carburetors, but were also positioned at some distance away from the combustion chamber in the intake manifold runner, or in the intake port. The spark plug remained in the combustion chamber.

The adoption of direct fuel injection now sites the fuel injector in the combustion chamber and not in the intake manifold runner or port. Therefore it has become necessary to find a suitable locus for the fuel injector in a combustion chamber. The combustion chamber in many modern designs, is filled with multiple poppet valve heads. Characteristically, the locus must allow the provision of a site for an additional aperture, preferably in the center of the chamber, for insertion of the fuel injector; in addition to the site for the igniter. This necessitates two apertures into more specifically, the top or roof of the already crowded combustion chamber. One or both of these apertures may be threaded. This adds expense as well as spatial compromise to the utilization of direct fuel injection technology. This feature is also typical of compression ignition internal combustion engines or diesels, with the exception that the igniter is adapted to be a glow plug.

This invention is made to address this conundrum by necessitating as is typical of internal combustion engines, only one aperture into the combustion chamber, even with the use of direct fuel injection.

SUMMARY OF THE INVENTION

The present invention resides in an igniter adapted to be a spark plug and a glow plug, housing the fuel injector within its body. It enables the injector to access the combustion chamber of an internal combustion engine, through a single aperture that is providing an access for the spark plug or glow plug. The body of the spark plug is constructed as an elongated tubular housing having, defined within it's center, an aperture along a longitudinal axis. This aperture extends from a polygonal shaped top, to the base of the body, and in a preferred embodiment, may be threaded. Within this aperture the fuel injector is sited. Encircling the aperture, is defined a groove or a channel within the body, in which is an electrode embedded in an insulator. Both also project along a longitudinal axis. This electrode defines a terminal at the polygonal shaped top, from which it projects, through a longitudinal tubular channel, to prongs at the base of the body. These prongs may be constructed to be in close proximity to the inner housing wall around the central chamber, or in an additional embodiment, to be directed towards the outer peripheral threaded housing wall. This electrode is insulated from the body, which is grounded. In typical use this electrode, carries a positive electrical charge when energized. In spark plugs, this charge jumps an air gap, towards the housing wall, creating a spark in the combustion chamber.

It is an accepted principle in the technology of internal combustion engines, that the center of the combustion chamber is the ideal location for the spark plug. It is also the ideal location for the fuel injector, but the prior art has never been able to demonstrate this fact, due to a simple statement of physics; until this invention. The benefits of direct fuel injection are further improved by this invention, resulting in additional gains in fuel efficiency, horsepower and torque.

An advantage of this invention, is that the coil and the fuel injector which were sited at varying positions, can now be assembled in unit with the spark plug, at the location of the aperture in the cylinder head into the combustion chamber.

A further advantage of this invention is that the two distinct electrical circuits needed to activate the fuel injector and the coils and park plug complex, are reduced to one. The current that activates the fuel injector, also activates the coil to discharge it's amplified, stored electrical energy to the spark plug in a sequence.

The advantages listed in [0007] also applies to compression ignition or diesel internal combustion engines, that utilize a glow plug. In this configuration, no coil is used. combustion engines, that utilize a glow plug. In this configuration, no coil is used.

The above, as well as other features and advantages of the present invention will become apparent from the following more detailed description and accompanying drawings. These illustrate the principles of the invention, as an example.

Figure 1:
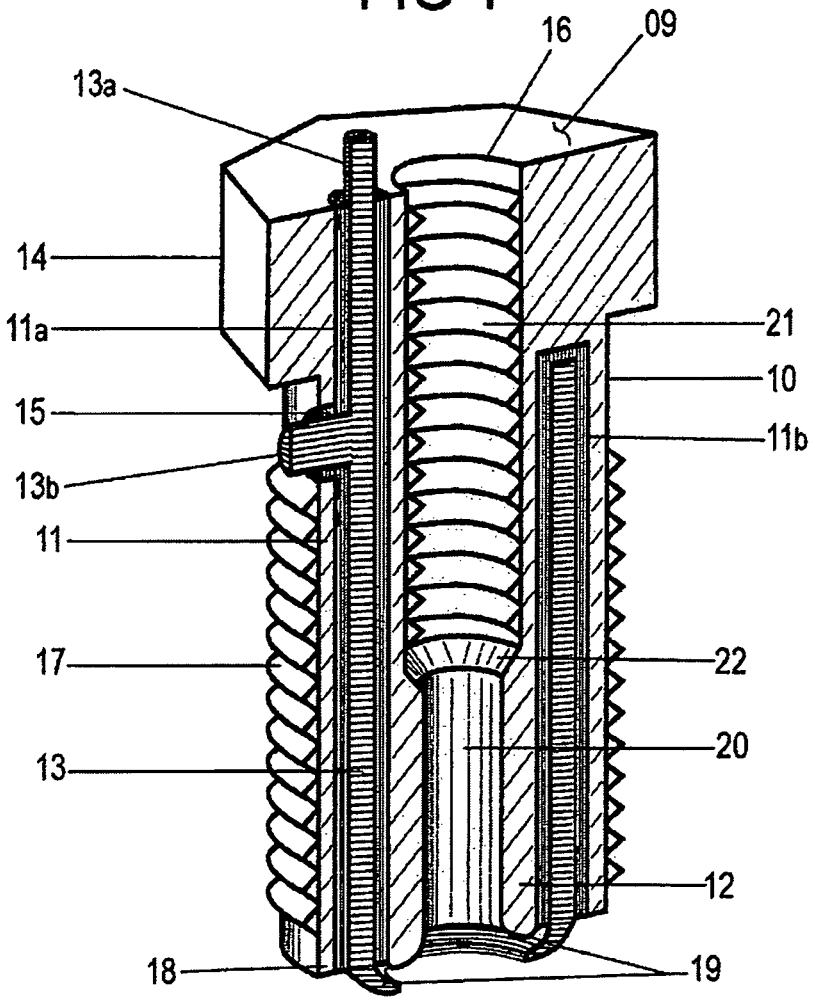
FIG. 1 Is a perspective cross-sectional view of a spark plug embodying this invention. It shows the electrode with a horizontal terminal and a vertical terminal.

| Drawings-Reference Numerals | |
|---|---|
| 09 | igniter |
| 10 | housing |
| 11 | outer housing wall |
| 11a | tubular channel |
| 11b | circular chamber |
| 12 | inner housing wall |
| 13 | electrode |
| 13a | terminal (vertical) |
| 13b | terminal (horizontal) |
| 14 | polygonal top |
| 15 | insulator |
| 16 | central aperture |
| 17 | screw threads-periphery |
| 18 | base |
| 19 | prong(s) |
| 20 | central chamber |
| 21 | screw threads-central chamber |
| 22 | ledge |
| 23 | shallow groove |
| 24 | shallow circular ring |
| 25 | circular lip |
| 30 | rings-spiral |

100 injector
101 coil
102 cylinder head
103 combustion chamber
104 combustion chamber contents

DETAILED DESCRIPTION OF THE PREFERRED EMBODIMENTS

Figure 2:
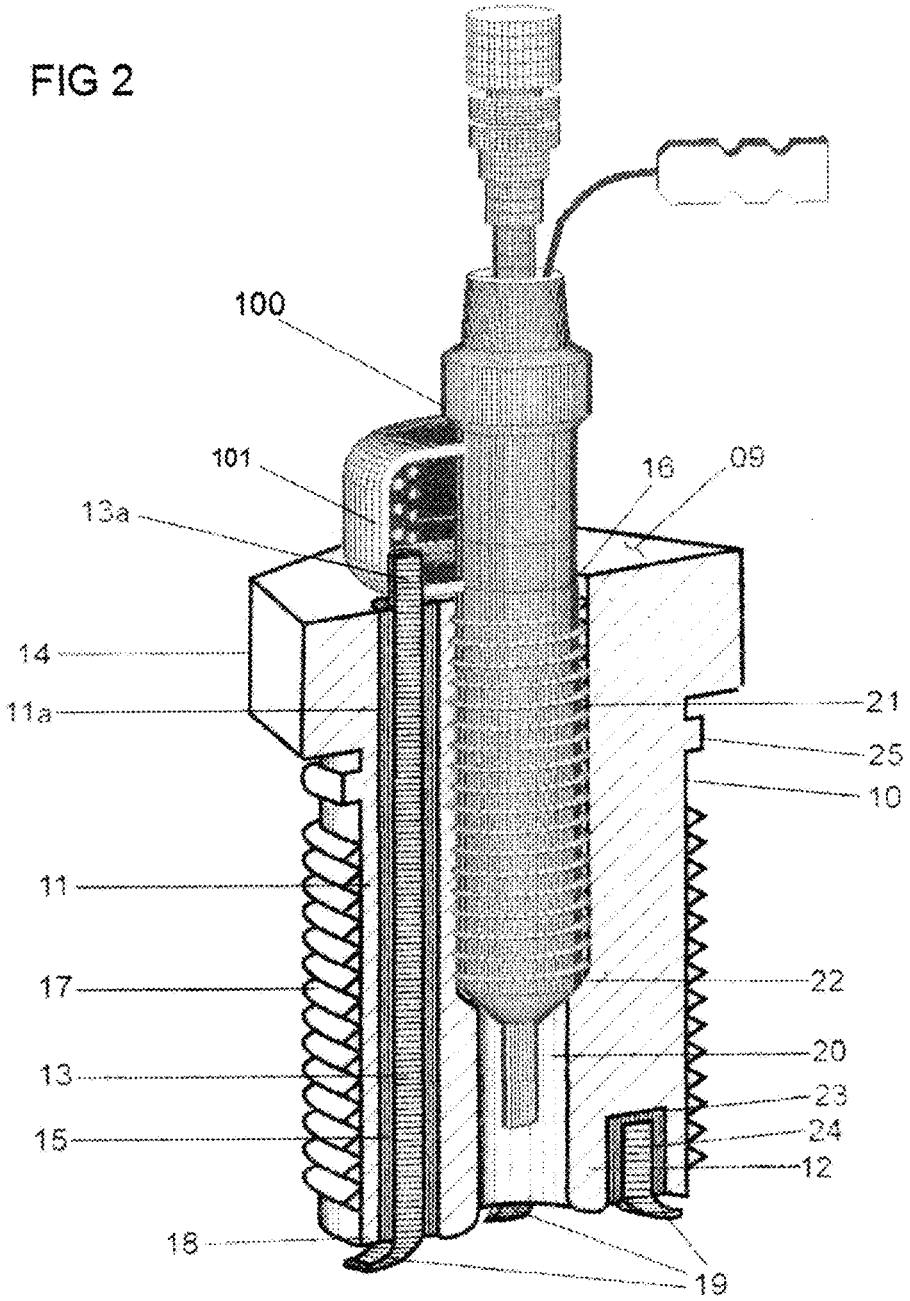
FIG. 2 Is a perspective cross-sectional view of a spark plug embodying this invention, having only one electrode terminal projecting through the polygonal shaped top and horizontal prongs directed towards the peripheral, grounded housing wall.

Shown in FIG. 1 and FIG. 2 illustrations of the invention are igniters 09 adapted to be spark plugs having an elongated tubular housing 10 along a longitudinal axis. An upper end is formed into a polygonal top 14 along a horizontal plane. The polygonal top 14 is octagonal in the preferred embodiment and provides the means for pivoting the devices of the invention. A series of screw threads 17 are disposed around the periphery of a part of the surface of the outer housing wall 11 adjacent it's base 18. When the screw threads 17 are engaged into the corresponding screw threads of the receiving aperture in a cylinder head of an internal combustion engine, the spark plug is mounted. The combustion chamber is accessed. An insulator 15 constructed of durable heat resistant material is disposed on all sides within a tubular channel 11*a* along a longitudinal axis in the polygonal top 14 and in the connecting circular chamber 11*b*, disposed within the housing wall 10. The circular chamber 11*b* defines an outer housing wall 11 and an inner housing wall 12. An electrode 13 as a conductor, is constructed of a durable conductive material as a tubular ring embedded within the insulator 15 on three sides within the circular chamber 11*b*. It extends along the longitudinal axis, from the polygonal top 14 to an end at the base 18. Terminal 13*a*, at the end of the electrode 13 projects through the polygonal top 14, to an end above it's surface. At least one terminal 13*b*, defined only in FIG. 1 is constructed as an alternate projecting along a horizontal axis, through housing wall 11 to an end beyond the periphery. Terminal 13*a* is the preferred embodiment. The electrode 13 is adapted as a prong 19 in the base 18, projecting from within the insulator 15, to a close proximity at an inner housing wall 12. An air gap is defined there between.

A central aperture 16 for the receipt of the fuel injector is defined in the surface of the polygonal top 14 of the igniter 09 and opens into a central chamber 20 disposed along a longitudinal axis to an end at the base 18. The central chamber 20 may have a series of screw threads 21 defined in the surface that extend from the central aperture 16 along the longitudinal axis to an end at the fuel injector receipt ledge 22 and is the preferred embodiment.

Figure 1A:
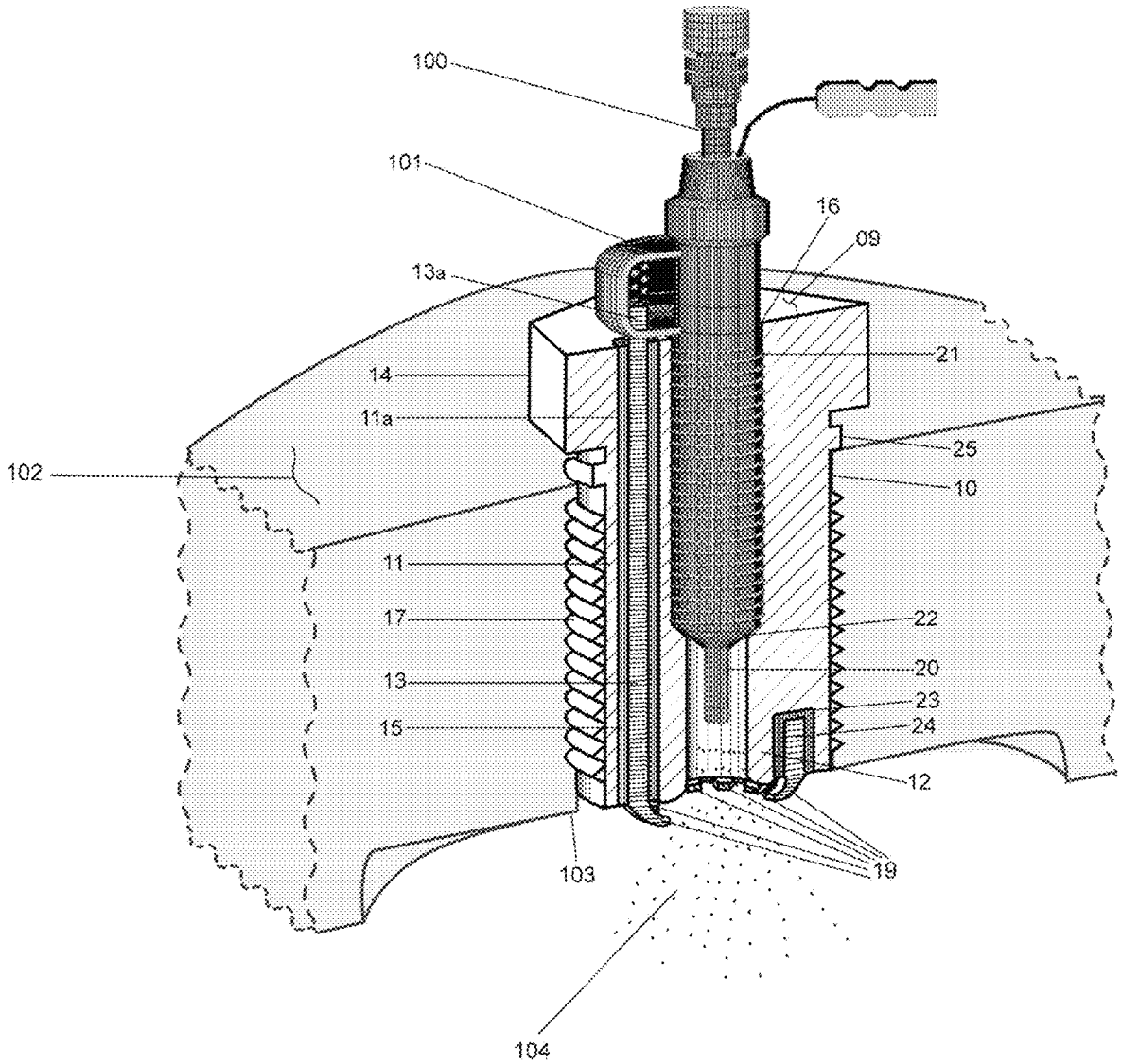
FIG. 1*a* Is a perspective cross-sectional view of FIG. 1 showing another embodiment of the electrode with multiple horizontal prongs, at the base.

FIG. 1A. illustrates another embodiment of the device of the invention having the electrode 13 adapted to define one or more prongs 19 in a ring at the base 18.

In FIG. 2 the circular chamber 11*b* is adapted as a shallow groove 23. Electrode 13 is adapted as a longitudinal post within tubular channel 11*a* extending from the polygonal top 14 to contact the shallow circular ring 24 adjacent to the base 18. The shallow circular ring 24 is embedded in the insulator 15 disposed within the shallow groove 23. One or more prongs 19 are adapted to project from the circular ring 24 across the insulator 15 towards the periphery. Prongs 19 end at a close proximity to the outer housing wall 11 defining the air gap there. A circular lip 25 may be disposed around the periphery of the outer housing wall 11 below the horizontal polygonal top 14 above the series of screw threads 17 and acts as a seal member to contain the contents of combustion within the combustion chamber.

Figure 3:
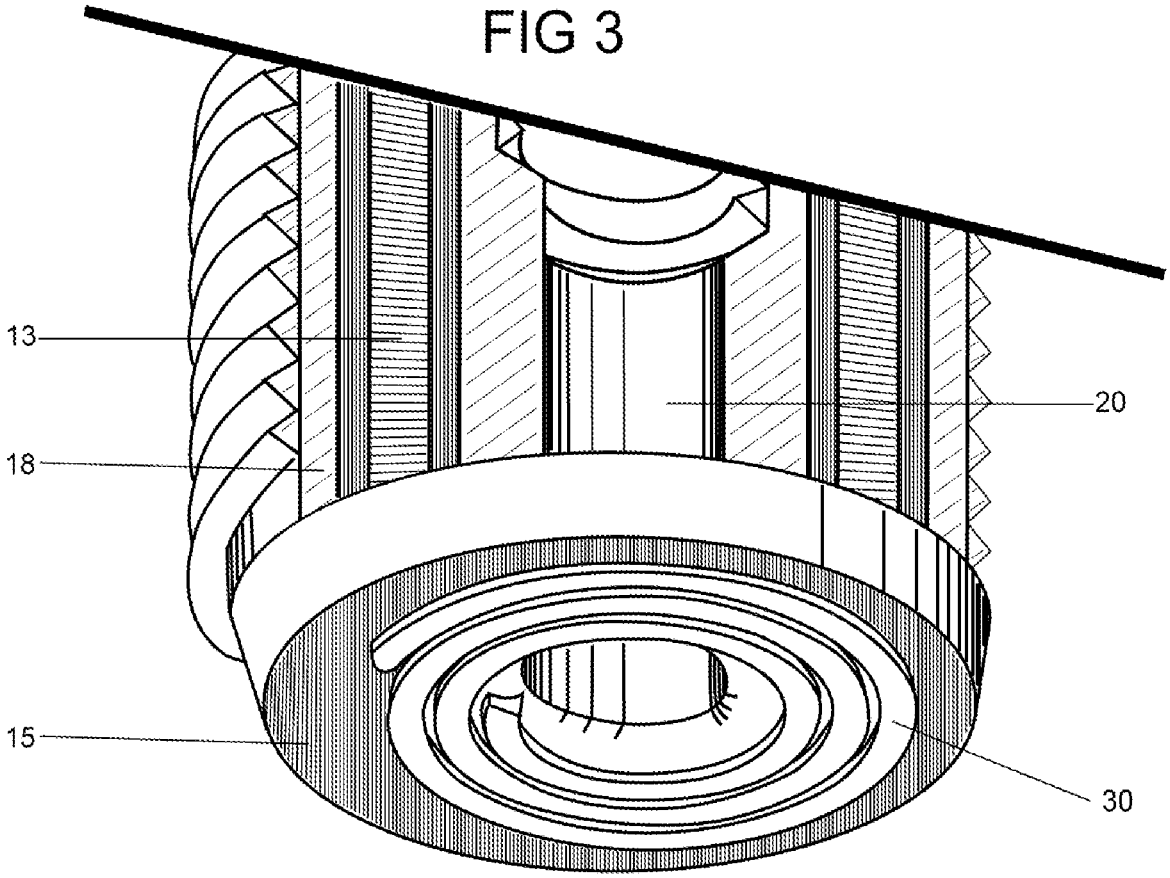
FIG. 3 Is a perspective cross-sectional and end view of the base adapted as a glow plug.

FIG. 3 illustrates a partial perspective cross section and an end view of the igniter 09 adapted as a glow plug. Electrode 13 projecting through insulator 15 which closes the shallow groove 23, is attached to a series of rings 30. The rings 30 are also embedded in the insulator 15. in the base 18. The rings 30 are constructed in a spiral around the central chamber 20 to an end in contact with the inner housing wall 12 where they are grounded. The rings 30 comprise a heating element.

Operation—FIGS. 1 and 1A and FIG. 2.

The igniter 09 embodied in my invention described in this application, is adapted as a spark plug. It functions to accomplish the same task as the current spark plug, used in direct fuel injection into the combustion chamber 103 of internal combustion engines. It is threadably inserted into the screw threads in the spark plug receipt aperture in the cylinder head 102 of the engine, engaging screw threads 17. A suitable tool grasping around the periphery of the polygonal top 14 pivots it. The plug moves through the aperture and is pivoted to a stop with circular lip member 25 as in FIG. 1A contacting the cylinder head 102, creating a seal. The base 18 is projected into the combustion chamber 103. The fuel injector 100 is inserted into the central aperture 16 in the polygonal top 14, and is moved through the communicating central chamber 20 to a stop at the fuel injector ledge 22, also creating a seal. The seals prevent combustion chamber contents 104 from escaping the combustion chamber 103. The fuel injector 100 may be secured in the igniter 09 in different ways, such as by a circlip, (not shown) after it is pushed into place. In the preferred design presentation presented, a series of screw threads 21 are the securing means. An electrical current from a source such as a battery, is timed and transmitted by a component such as an electronic control module, to a terminal on the fuel injector 100. This current activates the fuel injector 100 to spray pressurized fuel into the combustion chamber 103. In sequence, the electrical current is immediately transmitted to the coil 101, which may be sited around the fuel injector 100 atop the igniter 09, an advantage of my invention. This current activates the coil 101 to discharge it's stored, amplified current, through the contact at the terminal 13*a* or 13*b* if used. The electrical current is transmitted or conducted through the electrode 13, to the prongs 19. The prongs 19, are insulated from the grounded outer housing wall 11 and grounded inner housing wall 12, by the insulator 15. The spark then jumps the air gap between the prongs 19 according to a built in electrical resistance to, contact the grounded outer housing wall 11 and/or the grounded inner housing wall 12 completing it's circuit and the fuel and air mixture. The plurality of prongs 19 permits an associated plurality of sparks to be generated in different directions. This completes a timed cycle that is repetitive.

FIG. 3.

This embodiment of my invention of an igniter 09, is adapted as a glow plug. It functions to accomplish the same task as the current glow plug used in the combustion chamber of a compression ignition engine. An electrical current from a source such as a battery, is activated by a switch, and transmitted to the igniter to contact terminal 13*a* or 13*b*. The electrical current is transmitted or conducted through the electrode 13 to the rings 30 embedded in the insulator 15 in the base 18. The rings 30 spiral around the central chamber 20, creating a heating element, and are attached to the grounded inner housing wall 12. The electrical current activates the rings 30 to heat and ignite the fuel sprayed into the combustion chamber by the fuel injector located in the central chamber 20. The electrical current to the igniter is switched off, and combustion is thereafter sustained by a cycle of compression of air and fuel mixtures.

Conclusion, Ramifications And Scope.

Accordingly, the reader will see that the igniters in the various embodiments presented in the specification, and illustrations, have many advantages over the devices of the prior art. Their use allows the two or three devices of the ignition process, to be relocated to a discrete site, in the most beneficial locale; the entrance to the combustion chamber, and at its center. They solve the issue of spatial compromise, in the design of the combustion chamber, resulting in increased fuel efficiency, increased horsepower and torque. In addition, they reduce the increased cost of adopting direct fuel injection, by reducing the manufacturing costs involved in drilling another aperture and tapping it. Also, they reduce the electrical hardware and the manufacturing costs of electronic control modules, by requiring only one electrical pathway for activating the fuel injector and the coil. The prior art requires two pathways; one to the fuel injector and another to the coil. There are further benefits permitted by the use of multiple prongs. They provide multiple spark presentations, that are most compatible with the reduced amperage of current ignition systems. The results are reliable, stable and durable ignition. The benefits of direct fuel injection, some of which are well demonstrated in compression ignition engines, are now available with enhancements. These can be fitted to past, present and future internal combustion engines, having a single aperture through the cylinder head, into the combustion chamber.

Although the present invention has been described with reference to particular embodiments, it will be apparent to those skilled in the art, that variations and modifications can be substituted therefor without departing from the principles and spirit of the invention, or limiting it's scope. Thus the scope of the embodiments should be determined by the appended claims and their legal equivalents, rather than by the examples given.

What I claim is:

1. An igniter comprising:

a body electrically grounded in operation to an internal combustion engine, having an elongated tubular housing, the exterior of said body being operable to seal to a combustion chamber surface when mounted to said internal combustion engine;

an aperture through the center of said body, axially, to its base, said aperture configured to be closed by a removably retained fuel injector, confining combustion chamber contents within said combustion chamber and precluding leakage of said combustion chamber contents past said igniter;

an ignition device operable to ignite an air and fuel mixture within said combustion chamber, and an electrode disposed within an insulator embedded within said body, said electrode attached to a terminal connecting an electrical source outside said combustion chamber to said ignition device in said base, said ignition device, in activation, communicating electricity between said electrode and said body;

whereby said ignition device and fuel may be introduced into said combustion chamber through a common aperture in said combustion chamber.

2. The igniter of claim 1 wherein said ignition device comprises a resistive heating element, said resistive heating element being operable when an electrical current is applied to said electrode.

3. The igniter of claim 1, wherein said ignition device comprises an air gap through bridged by at least one spark when an electrical current is applied to said electrode.

4. The igniter of claim 1, wherein threads are defined in the external surface of said igniter body.

5. The igniter of claim 4, wherein a polygonal shape is defined upon the upper surface of said igniter body.

6. An igniter comprising:

a body having an elongated tubular housing;

an aperture through said body, said aperture operable to pass pressurized fuel from a removably retained fuel injector to a combustion chamber;

an inner housing wall and an outer housing wall defined by a ring-shaped chamber formed within said body and around said aperture, said inner housing wall and said outer housing wall both being electrically grounded to an internal combustion engine;

an ignition device operable to ignite an air and fuel mixture within said combustion chamber; and an electrode disposed within said ring-shaped chamber, said electrode connecting an electrical source outside said combustion chamber to said ignition device, said ignition device, in activation, communicating electricity between said electrode and said body;

whereby said ignition device and pressurized fuel may be introduced into said combustion chamber through a single aperture.

* * * * *